United States Patent [19]

DeLoach et al.

[11] 4,134,120

[45] Jan. 9, 1979

[54] WHIP ANTENNA FORMED OF ELECTRICALLY CONDUCTIVE GRAPHITE STRANDS EMBEDDED IN A RESIN MATERIAL

[75] Inventors: Thomas R. DeLoach; Walter W. Kusek, both of Hampton, S.C.

[73] Assignee: Coastal Engineered Products Company, Inc., Varnville, S.C.

[21] Appl. No.: 731,305

[22] Filed: Oct. 12, 1976

[51] Int. Cl.[2] ..... H01Q 1/32

[52] U.S. Cl. ..... 343/715; 343/900

[58] Field of Search ..... 343/715, 873, 900; 338/214; 264/29.2, 136, 137; 423/447.2

[56] References Cited

U.S. PATENT DOCUMENTS

| | | | |
|---|---|---|---|
| 2,972,744 | 2/1961 | Rickards et al. | 343/873 |
| 3,541,567 | 11/1970 | Francis et al. | 343/873 |
| 3,716,869 | 2/1973 | Gould et al. | 343/912 |
| 3,725,944 | 4/1973 | Valeriote | 343/900 |
| 3,870,987 | 3/1975 | Wiley et al. | 338/214 |
| 3,919,376 | 11/1975 | Schulz | 264/29.2 |
| 3,943,020 | 3/1976 | Ashton et al. | 264/137 |

*Primary Examiner*—Eli Lieberman

*Attorney, Agent, or Firm*—Kenneth P. Synnestvedt

[57] ABSTRACT

The antenna disclosed is formed of fiber reinforced resin material, having reinforcing fibers in the form of strands of electrically conductive graphite, the strands being embedded under tension in the shaft of the antenna to provide high stiffness, and the graphite strands being electrically connected with a metal antenna lead-in terminal at the base end of the antenna shaft.

2 Claims, 5 Drawing Figures

WHIP ANTENNA FORMED OF ELECTRICALLY CONDUCTIVE GRAPHITE STRANDS EMBEDDED IN A RESIN MATERIAL

This invention relates to communication antennas and particularly to antennas as employed on automobiles and trucks, and the antenna structure of the invention is especially adapted for use with high frequency radio communication systems, such as the systems commonly referred to as CB radios.

The shafts of antennas commonly used for the purposes indicated are formed either of metal or of glass fiber reinforced resin materials, notably thermosetting materials, such as polyester resins. In the case of the metal antennas, the antenna lead-in connection or terminal is of course electrically connected with the metal shaft of the antenna and in the case of the glass fiber reinforced resin antennas, a metal or wire conductor is embedded within the antenna, and the lead-in terminal is electrically connected to the wire or conductor.

For certain purposes and under certain conditions, the antennas commonly in use provide an effective radiating and receiving device, but under certain conditions and especially at any appreciable translation speed of the vehicle on which the antenna is carried, the antennas commonly in use are subject to substantial flexure, with resultant tendency to flutter and vibrate.

It has been found that the flexure, fluttering and vibration of the common antennas is disadvantageous for a number of reasons, notably because under certain conditions, especially conditions encountered at highway cruising speeds, the fluttering or flexing of the antennas adversely affect the operation of the antenna in radiating or receiving the desired high frequency signal. For example, the vibration or fluttering results in loss of efficiency.

With the foregoing in mind, it is a major objective of the present invention to provide an antenna of which the shaft is formed of materials imparting greatly increased stiffness to the antenna, to thereby extensively reduce or overcome substantial flexure and flutter in use, even at high cruising speeds.

Although it may theoretically be possible to increase the stiffness of antennas of known type merely by increasing the diameter of the antenna shaft, substantail increase as compared with the sizes commonly in use, has disadvantages including the fact that at cruising speeds the increased air resistance imparts excessive bending loads to the antenna mounting. Indeed, with the commonly employed magnetic mounting currently in use for many CB radio antennas, a substantial increase in the diameter of the antenna shaft would increase the air resistance to the point where the magnetic mounting would not be adequate to maintain the antenna in operating position.

Having the foregoing in mind, the present invention contemplates the selection of the materials of which the antenna shaft is formed so as to provide extensive increase in the stiffness of the antenna without increase in the diameter of the antenna shaft. This is accomplished according to the present invention by the formation of the antenna from resin material reinforced with fibers in the form of strands of graphite or of other similar electrically conductive carbon-containing fibers having a high modulus of elasticity. The reinforcing fibers are embedded in the resin material under tension lengthwise of the shaft.

Since these fibers are electrically conductive, the employment of the fibrous strands in this manner not only extensively increases the stiffness of the antenna shaft, but also provides another advantage, namely it eliminates the necessity of employing a central wire or conductor as has been employed in glass fiber reinforced resin antennas and the invention contemplates the employment of a metal antenna lead-in terminal at the base of the shaft, which terminal is electrically connected with the reinforcing strands.

How the foregoing objects and advantages are attained will appear more fully from the accompanying drawings illustrating a preferred embodiment of the invention, and in which.

Figure 5:
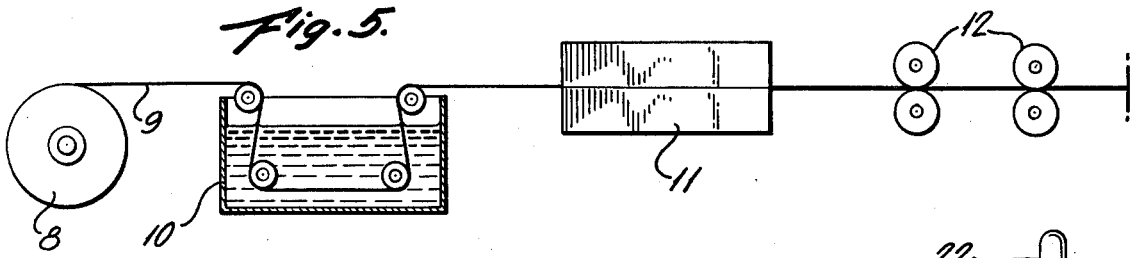
FIG. 5 is a diagrammatic view illustrating the preferred technique for manufacture of antennas according to the present invention.

The antenna shaft is identified by the numeral 6 in the drawings and the base end of the shaft is received in the ferrule 7 which preferably has a closed end and which has an inside diameter approximating the outside diameter of the shaft. The shaft of the antenna is formed of resin material reinforced at least in large part with high modulus electrically conductive fibers and for the purpose of fabrication of such shafts, a pultrusion operation is preferably employed. Such a technique is diagrammatically illustrated in FIG. 5. At the left is a supply means 8 for multi-filament strands indicated at 9, preferably a plurality, for instance nine strands being used, and the strands are drawn through a bath of a liquid thermosetting resin in a reservoir indicated at 10.

The resin impregnated strands are then drawn through the forming and curing die indicated at 11, puller mechanism such as pairs of puller rollers indicated at 12 being shown at the downstream side of the die. The die may be arranged according to known techniques, preferably providing for heating of the fiber reinforced material as it is advanced through the die passage, and the die passage is preferably shaped to conform with the desired cross section of the shaft being made. Pultrusion dies of this type are known and need not be considered in detail herein.

Various thermosetting resins may be employed, such as the commonly available polyester resins or epoxy resins, or thermosetting vinyl resins. The resin material is heated to cure the resin and thus to solidify the shaft before delivery from the die 11, so that the pulling rollers 12 may grip the solidified article and thus feed the article to a downstream cutter or the like, thereby providing for cutting off lengths of the pultrusion at the desired intervals.

The fibers employed are preferably graphite fibers in multi-filament strand form, advantageously fibers having a modulus of elasticity of at least 28,000,000 psi, for instance in the neighborhood of 35,000,000. The use of such fibers in the antenna shaft, particularly when produced by a pultrusion technique, results in embedment of the strands in the cured resin, with the stands under tension lengthwise of the shaft, thereby providing a favorable condition from the standpoint of maximizing stiffness of the shaft.

The strands are advantageously of size yielding from about 225 yards to about 1200 yards per pound, and the total quantity of strands employed in relation to the amount of resin in the article is such as to provide a fiber content of from about 35% to about 65% of the total weight of the shaft. In this way, with a shaft of from about 0.100 inches to about 0.187 inches in diameter, for instance 0.135 inches, the antenna as a whole would contain from about 3 strands to about 50 strands and would have a modulus of elasticity upwards of about 14,000,000 psi. In a typical example with the shaft of 0.135 inches in diameter, the modulus would be about 15,000,000 psi.

Figure 3:
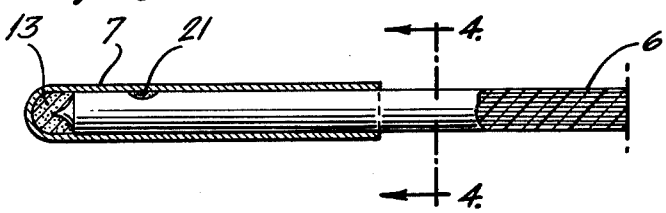
FIG. 3 is an enlarged fragmentary view of the base end of the antenna structure, with the metal lead-in terminal shown in axial section.
Figure 4:
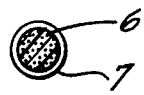
FIG. 4 is a transverse sectional view taken as indicated by the section line 4—4 on FIG. 3.
Figure 1:
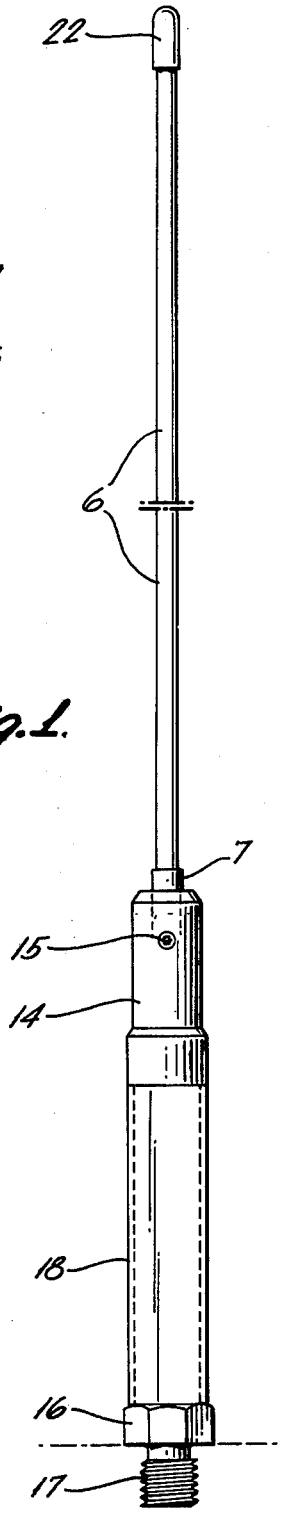
FIG. 1 is an elevational view of an antenna constructed according to the present invention and mounted on a base end mounting structure.
Figure 2:
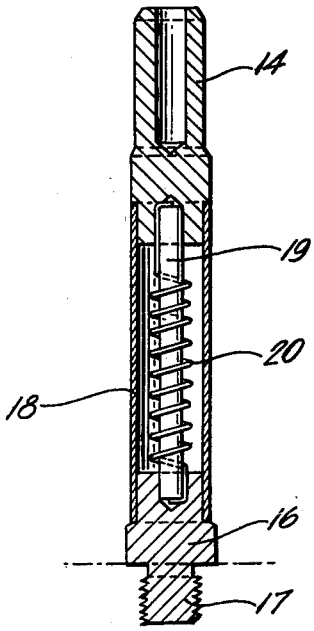
FIG. 2 is an axial sectional view through the base end mounting structure.

Referring again to FIGS. 1, 3 and 4, it is noted that the base end of the shaft within the ferrule 7 is preferably ground to a tapered shape as indicated in FIG. 3, so as to expose the end portions of at least most of the electrically conductive strands, and for purposes of electrical continuity in the antenna system, a joint 13 is provided at the base end of the shaft at the bottom of the ferrule. For the purpose of making this joint, either a conductive adhesive or a solder may be used. For example, a soldering compound of 40/60 (tin to lead) type may be used, for instance the material available on the market under the tradename "44" Resin Core Solder as manufactured by Kester Solder Div. of Litton Systems, Inc.

Alternatively one of the known types of electrically conductive plastic adhesives may be used, for instance the adhesive available on the market under the tradename "Eco-bond 57-C" as manufactured by Emerson and Cuming, Canton, Mass.

As with various antennas for the general purposes here involved, a base mounting arrangement is provided, commonly including a socket member 14 in which the ferrule 7 is received, and a set screw 15 may be provided for ensuring retention of the antenna in the socket.

A base member 16 is provided, having a threaded shank 17 which may be screwed into any appropriate mounting device which provides not only for continuity of the antenna circuit, but also for electrical isolation or insulation of the circuit from the structure of the vehicle on which the antenna is carried, for instance the roof or trunk lid. The socket 14 and the base member 15 are interconnected by the tube 18 which is advantageously formed of material such as fiber glass reinforced plastic or other insulating material, and within the tube 18, a central spindle 19 extends between sockets provided in the members 14 and 16, this spindle also being of insulating material and serving to mount the loading coil or resonator 20 which is connected at its ends with the members 14 and 16. Such coils are well known in use of equipment of the kind here under consideration, and the details of the construction or the electrical values thereof form no part of the invention per se.

For the purposes of providing additional mechanical interlock between the antenna shaft and the base end ferrule 7, the shaft is desirably notched in its side wall within the ferrule and an additional adhesive or soldered joint 21 is provided. A plastic, for instance vinyl, tip or cover 22 is advantageously placed upon the free end of the antenna shaft.

The length of antennas of the kind referred to above may conform with that required for the frequency range in which the equipment is intended to operate, for instance the length may be of the order of 30 inches to 96 inches.

As above indicated, it has been found that antennas constructed as above described are virtually flutter free even at highway cruising speeds of the order of 50 to 60 miles per hour. In consequence improved transmission and reception is achieved particularly in frequency bands as used in CB radios.

We claim:

1. An antenna structure comprising a shaft formed of fiber reinforced resin material, the reinforcing fibers being in the form of strands extended longitudinally of the shaft and embedded in the resin material under tension lengthwise of the shaft, reinforcing strands being distributed throughout the section of the shaft and extended in spaced relation to each other throughout the length of the shaft, the reinforcing fibers comprising from about 35% to about 65% of the total weight of the shaft and the reinforcing fibers of the strands being formed of electrically conductive graphite having a modulus of elasticity of at least 28,000,000 psi, and a metal antenna lead-in terminal at one end of the shaft electrically connected with graphite reinforcing strands in the shaft.

2. An antenna structure as defined in claim 1 in which the lead-in terminal comprises a ferrule surrounding the base end of the antenna and soldered or adhesively bonded to graphite fibers adjacent said base end.

* * * * *